United States Patent [19]

Kloke

[11] 4,267,657

[45] May 19, 1981

[54] ILLUMINATED SIGN

[75] Inventor: Werner Kloke, Whitby, Canada

[73] Assignee: Prem Gandy, Downsview, Canada

[21] Appl. No.: 50,362

[22] Filed: Jun. 20, 1979

[51] Int. Cl.[3] ..... G09F 13/04

[52] U.S. Cl. ..... 40/549; 40/574; 40/578

[58] Field of Search ..... 40/549, 572, 574, 578, 40/152, 152.1, 156

[56] References Cited

U.S. PATENT DOCUMENTS

| | | | |
|---|---|---|---|
| 3,013,475 | 12/1961 | Spangler | 40/574 |
| 3,593,448 | 7/1971 | Schoepf | 40/574 |
| 3,863,372 | 2/1975 | Stilling | 40/549 |
| 4,088,881 | 5/1978 | Neer et al. | 40/574 |
| 4,169,327 | 10/1979 | Stilling | 40/578 |

FOREIGN PATENT DOCUMENTS

| | | | |
|---|---|---|---|
| 750111 | 1/1967 | Canada | 40/574 |

*Primary Examiner*—John F. Pitrelli

*Attorney, Agent, or Firm*—Hirons, Rogers & Scott

[57] ABSTRACT

An illuminated sign comprises a casing having a front wall comprising a frame supporting a light-transmitting panel. The front wall is pivoted about its upper edge where it is connected to the top wall of the casing. The front edge of the top wall has a C-shaped groove extending along it which opens to the front of the casing. The upper frame element of the front wall has a generally L-shaped flange extending towards the groove, the distal limb of that flange being directed upwardly and terminating in a longitudinally extending bead which, cooperating with the interior surface of the C-shaped groove of the front edge of the top wall, constitutes a hinge about which the front wall can be swung to allow access to the interior of the casing. The L-shaped flange of the top frame element of the front wall provides a drainage channel along which rain water, which might otherwise stain the panel, is conducted.

6 Claims, 6 Drawing Figures

ILLUMINATED SIGN

This invention is concerned with illuminated signs. These signs comprise a box-like casing with a front wall and possibly also a rear wall constituted of a panel of a translucent or transparent material such as plexiglas. Within the casing illuminating means, conventionally one or more fluorescent tubes, is disposed.

With such devices there is a need to provide access to the interior of the casing to repair or replace the components of the sign within the casing, and to this end the front wall is commonly hinged to the remainder of the casing. This structure is one which has often detracted from the appearance of these units.

Additionally, it has been found that where the units are used in an outdoor environment the panel may become stained by rain water and the like running from the top surface of the casing across the panel.

The present invention seeks to provide an illuminated sign which is of pleasing appearance, of simple construction and is provided with drainage means which substantially alleviate the problem hereabove.

According to the present invention, there is provided an illuminated sign comprising a casing having top, side, bottom, front and rear walls wherein a front edge of a top wall has a generally C-shaped groove extending therealong and opening to the front of the casing, said front wall comprises interconnected top, bottom and side frame elements supporting a light-transmitting panel, the top frame element being an extrusion and comprising a generally L-sectioned flange extending from a rear surface thereof towards the interior of the casing and the distal limb of the flange being directed upwardly and terminating in a longitudinally extending bead, said distal limb being received within said C-shaped groove and the bead defining a hinging surface cooperating with an interior surface of said groove to support the front wall for hinging movement about an axis of the bead. The flange defines a drainage channel tending to lead liquid away from the panel of the front wall.

A preferred embodiment of the present invention is illustrated in the accompanying drawings in which.

Figure 1:
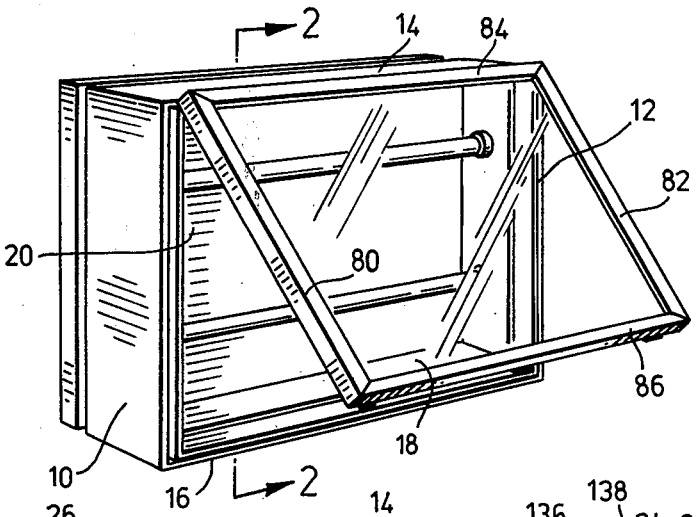
FIG. 1 is a perspective view of the sign according to the present invention.
Figure 2:
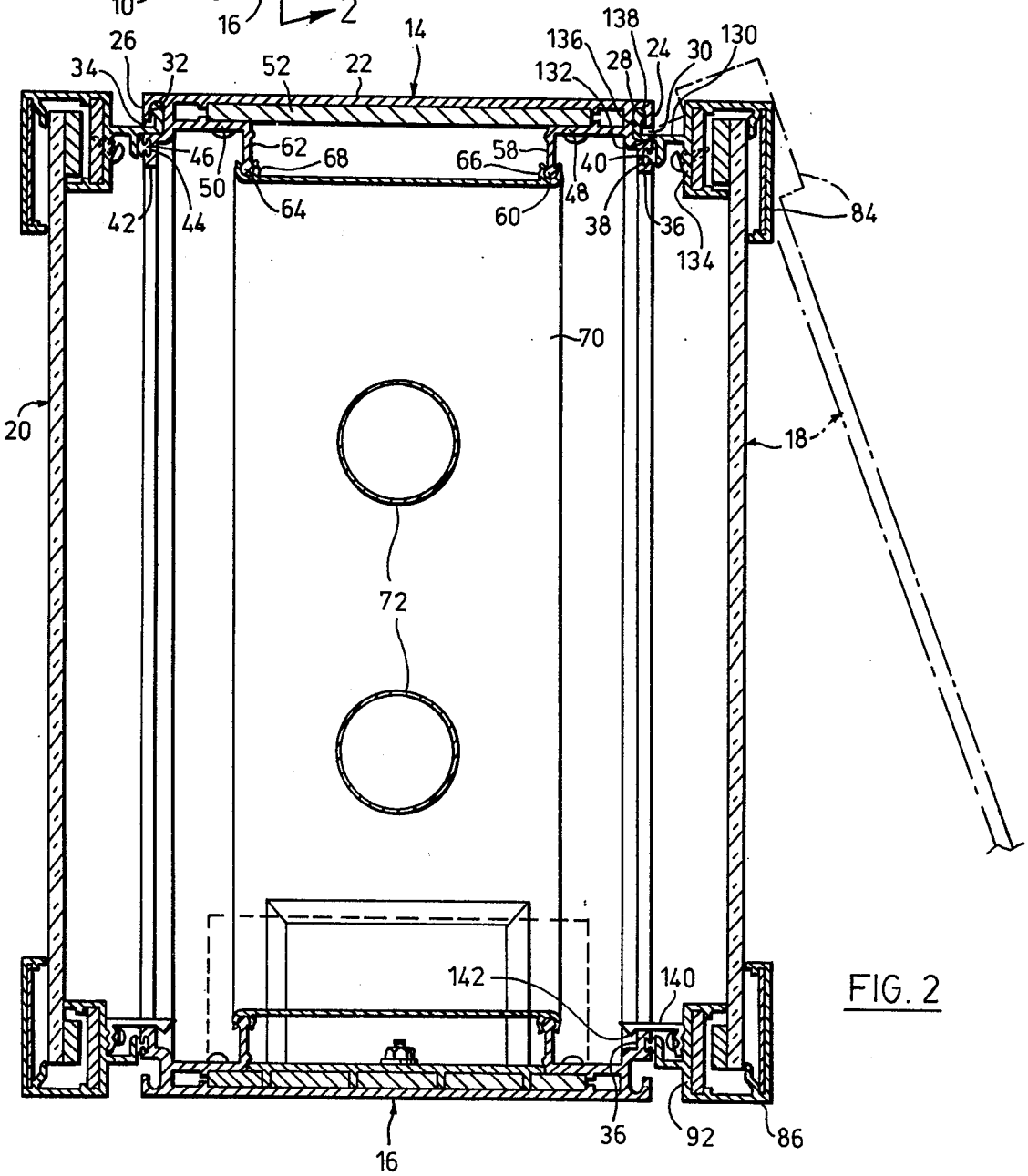
FIG. 2 is a vertical section on the line 2—2 of FIG. 1.
Figure 3:
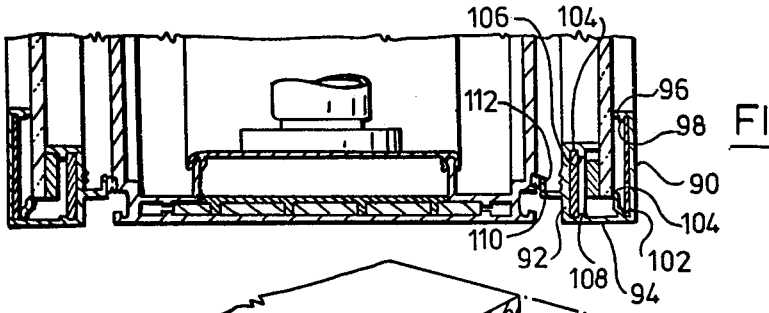
FIG. 3 is a horizontal section on the line 3—3 of a part of the structure of FIG. 1.
Figure 4:
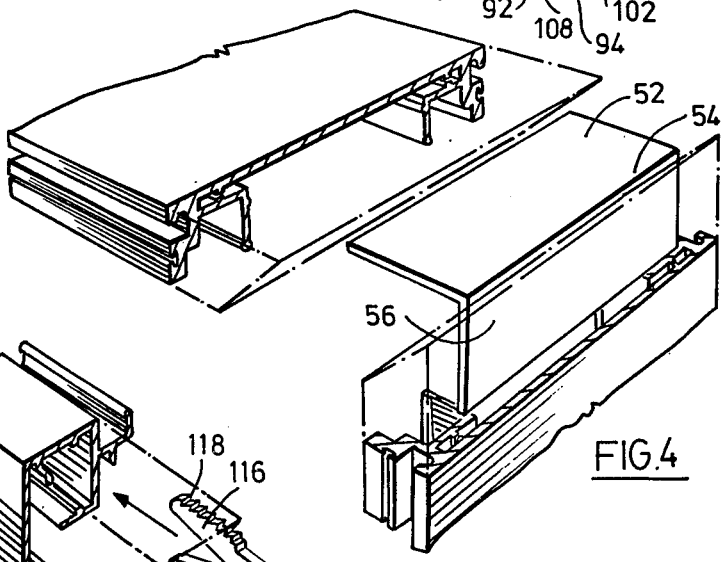
Figure 5:
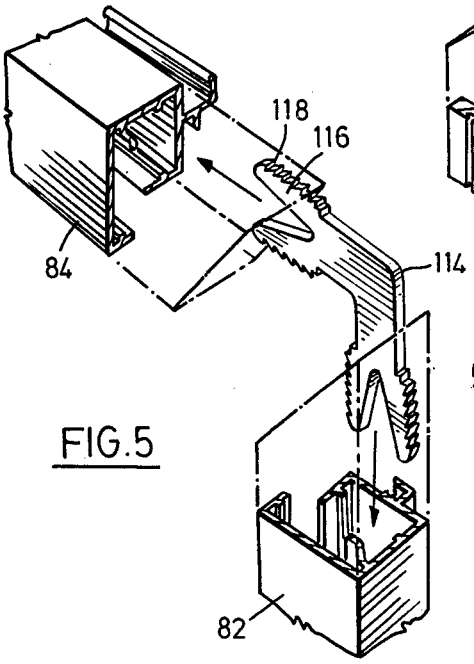
Figure 6:
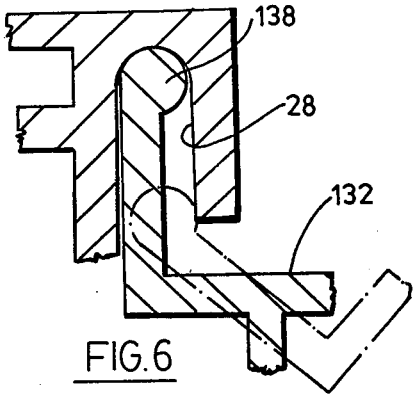

FIGS. 4 and 5 are perspective views of details of the structure of FIGS. 1, 2 and 3; and FIG. 6 is a cross sectional detail of the hinge of the sign of FIGS. 1 through 5.

The unit in the drawings is a double faced illuminated sign, that is to say, both front and rear walls carry advertising or directional information. The unit comprises opposed side walls 10 and 12, opposite top and bottom walls 14 and 16, and front and rear walls 18 and 20. The side walls 10, 12 and the top and bottom walls 14 and 16 respectively are similar, being formed from an extrusion, the form which can be seen particularly in FIG. 2. The extrusion is particularly described with reference to the top wall in FIG. 2 and comprises a generally planar web 22 which has a configuration 24 at its front edge and a similar configuration 26 at its rear edge, the expressions front and rear being used relative to the orientation of the top wall 14 in the casing. Configuration 24 defines a generally C-shaped groove 28 opening to the front of the casing as at 30 and similarly, configuration 26 has a groove 32 opening to the rear of the casing as at 34. A downwardly projecting flange 36 has a T-sectioned groove 38 within which a correspondingly shaped weather sealing strip 40 is disposed to cooperate, in a manner described hereinafter, with an adjacent portion of the front wall 18.

Configuration 26 similarly has a downwardly directed flange 42 with a T-sectioned groove 44 within which a weather proofing strip 46 is disposed, that strip cooperating, again as described hereinafter, with an adjacent portion of the rear wall 20.

Parallel to and slightly spaced from web 22, the configuration 24 has a flange 48 and configuration 26 has a similar flange 50. The space defined between the flanges 48 and 50 and the web 22 receive one limb 52 of an L-shaped connecting element 54, most clearly seen in FIG. 4, of which the other limb 56 is received within a corresponding space in the extrusion forming the side walls so that the mitered ends of the top and side walls can be united to form a corner.

Projecting downwardly from the end of the flange 48 is a flange portion 58 terminating in a bead 60. Similarly, flange 50 has a flange portion 62 terminating in bead portion 64. Secured to the beads 60 and 64 by appropriate connecting configurations 66 and 68 is a mounting plate 70 upon which fluorescent tubes 72 and their associated equipment are supported.

The front and rear walls 18 and 20 are substantially similar and for this reason only one of them is described in detail herein. The front wall is made up of a pair of side frame elements 80 and 82 and top and bottom frame elements 84 and 86 respectively, frame elements 80, 82 and 86 being sections of a similar extrusion. The section of the extrusion forming frame element 80, 82 and 86 can be seen particularly in FIG. 3 and is described with reference to that Figure. The extrusion comprises a generally U-shaped section having limbs 90 and 92 and a bight section 94. At the distal end of limb 90 an inwardly projecting flange 96 is formed and partway along that flange there is an inwardly directed ridge 98. Close to the junction of limb 90 and bight section 94 a dogleg section 100 is formed which has, for a purpose described hereinafter, flat surfaces at 102 and 104.

At the distal end of limb 92 an inwardly directed flange 104 is formed, that flange having a rib 106 directed towards and aligned with a similar rib 108 of bight section 94.

Projecting from the outside surface of limb 92 is an L-section flange 110 the surface 112 of one limb of which constitutes an abutment against which the neoprene seal 40 of the side and top and bottom walls engages to preclude the ingress of moisture and dirt to the interior of the casing.

Marginal edges of panel 18 are secured in the extrusion by interengagement with the opposed end surfaces of flanges 96 and 104 and with the surface 104 of dogleg 100.

As can be seen from a consideration of FIG. 5, the mitered ends of a pair of frame elements made up of the extrusions are united by means of a generally L-shaped corner piece 114 the limbs of which are bifurcated as at 116, the outer surfaces of which are provided with teeth 118. The corner pieces 114 are received in the space between the inner surface of limb 90 and the adjacent surface of rib 98 and surface 102 of dogleg 100.

The extrusion which forms the upper frame element of the wall 12 is similar to the extrusion which forms frame element 80, 82 and 96 except that, as can be seen in FIG. 1, the L-shaped flange 130 which corresponds to L-shaped flange 110 of frame element 80, 82 and 86, is extended, comprising a section 132 generally normal to limb 134 of the U-shaped extrusion which corresponds to limb 92, and an upwardly directed portion 136 terminating in a bead 138 which is engaged with a corresponding surface 28 of the C-shaped groove of the front edge of the top wall. Thus the front wall constituted by the frame elements 80, 82, 84 and 86 is mounted for pivoting movement about the axis of bead 138.

Secured to the limb 92 of the lower frame element 86 is a neoprene catch 140 terminating in a latching configuration 142 for engagement behind the flange 36 so that the front panel is held firmly in the closed position but upon the application of an opening force the clip will deflect to permit the front wall to be opened.

The groove within which the bead 138 is received and the bead itself are so designed that the front wall may be pivotally moved in a controlled fashion over an arc of about 45° to the position shown in chain line in FIG. 6 and will hold in that position, with the bead bearing against the front edge of groove 28. Movement of the wall beyond that angular disposition to about 70°–75° will permit the bead to be disengaged from the groove and the front wall to be physically removed from the casing.

It is to be noted that the structure here described is one in which no screws are visible from the exterior of the casing, all connections being made from the interior surfaces of the casing. Additionally, the upper surfaces of flange 130 provides a drainage channel along which water collecting on the upper surface of the casing can be directed to the side regions and be prevented from reaching the translucent panel 18 and possibly staining that panel. Further the combination of the clip and pivot arrangement is one which provides for positive securement of the front wall in the closed position while permitting the easy opening of the front wall, its controlled movement over a large arc and its subsequent removal from the casing.

The design is simple and easily assembled and repaired on site. The parts may, as desired, be of aluminum or other extrudable material such as, for example, polyvinylchloride.

I claim:

1. An illuminated sign comprising a casing have top, side, bottom, front and back walls wherein a front edge of a top wall has a generally C-shaped groove extending therealong and opening to the front of the casing, said front wall comprising interconnected top, bottom and side frame elements supporting a light-transmitting panel, the top frame element being an extrusion and comprising a generally L-sectioned flange extending from a rear surface thereof towards the interior of the casing, the distal limb of the flange being directed upwardly and terminating in a longitudinally extending bead, said distal limb being received within said C-shaped groove and said bead defining a hinging surface cooperating with an interior surface of said groove to support the front wall for hinging movement about an axis of said bead, said flange defining a drainage groove, said bead and groove having cooperating cylindrical surfaces constituting means permitting controlled hinging movement of said front wall relative to said top wall from a closed position, over a large angle and constituting means permitting removal of said front wall from said top wall upon movement beyond said angle, said front wall being pivotable from said closed position to a first position in which it is held by engagement of said flange and said front edge of the top wall and from that first position to a second position beyond said large angle, in which it can be removed from the sign.

2. A sign as claimed in claim 1 wherein front edges of said top, bottom and side walls have surfaces confronting surfaces of adjacent ones of said top, bottom and side frame elements of said front wall, said front edges or said surfaces of said top, bottom and side frame elements having resilient sealing means secured thereto.

3. A sign as claimed in claim 2 wherein said resilient sealing means comprises a seal strip secured in recesses of said front edges or said surfaces of said top bottom and side frame elements.

4. A sign as claimed in claim 1 wherein said bottom frame element and said bottom wall have cooperating catch configurations for securing said front wall in a closed position.

5. A sign as claimed in claim 1 wherein said first position is approximately 45° from the closed position of said front wall.

6. A sign as claimed in claim 1 or claim 5 wherein said second position is between about 70° and about 80° from a closed position of said front wall.

* * * * *